US010903559B2

(12) United States Patent
Lin et al.

(10) Patent No.: US 10,903,559 B2
(45) Date of Patent: Jan. 26, 2021

(54) LIQUID-CRYSTAL ANTENNA DEVICE AND MANUFACTURING METHOD OF THE SAME

(71) Applicant: InnoLux Corporation, Miao-Li County (TW)

(72) Inventors: Yi-Hung Lin, Miao-Li County (TW); Chin-Lung Ting, Miao-Li County (TW); Hui-Min Huang, Miao-Li County (TW); Tang-Chin Hung, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 98 days.

(21) Appl. No.: 16/047,127

(22) Filed: Jul. 27, 2018

(65) Prior Publication Data

US 2019/0051979 A1 Feb. 14, 2019

Related U.S. Application Data

(60) Provisional application No. 62/542,369, filed on Aug. 8, 2017.

(30) Foreign Application Priority Data

Feb. 12, 2018 (CN) ..... 2018 1 0146977

(51) Int. Cl.
*H01Q 1/36* (2006.01)
*H01Q 1/40* (2006.01)
(Continued)

(52) U.S. Cl.
CPC ..... *H01Q 1/364* (2013.01); *H01Q 1/40* (2013.01); *H01Q 3/34* (2013.01); *H01Q 9/0407* (2013.01); *H01Q 9/0442* (2013.01)

(58) Field of Classification Search
CPC ..... H01Q 1/364
See application file for complete search history.

(56) References Cited

U.S. PATENT DOCUMENTS 7,595,857 B2 9/2009 Yang et al.
9,229,280 B2 1/2016 Fan
(Continued)

FOREIGN PATENT DOCUMENTS

CN 1987584 A 6/2007
CN 102854651 A 1/2013
(Continued)

OTHER PUBLICATIONS

Chinese language office action dated Dec. 27, 2019, issued in application No. CN 201810146977.2.
(Continued)

*Primary Examiner* — Daniel Whalen
(74) *Attorney, Agent, or Firm* — McClure, Qualey & Rodack, LLP

(57) ABSTRACT

A method for manufacturing a liquid-crystal antenna device is provided. The method includes step (a) providing a first mother substrate. The first mother substrate includes a first region and a second region. The first region has a plurality of first sides. An extension line of at least one of the first sides divides the second region into a first part and a second part. The method also includes the following steps: (b) forming a first electrode layer on the first region and the second region, and (c) cutting the first mother substrate along the first sides of the first region.

13 Claims, 10 Drawing Sheets

(51) Int. Cl.
*H01Q 9/04* (2006.01)
*H01Q 3/34* (2006.01)

(56) References Cited

U.S. PATENT DOCUMENTS

| | | | | |
|---|---|---|---|---|
| 2007/0146622 | A1* | 6/2007 | Yang | G02F 1/1341 349/187 |
| 2014/0085579 | A1* | 3/2014 | Fan | G02F 1/1339 349/123 |
| 2016/0259214 | A1 | 9/2016 | Liu | |
| 2017/0221927 | A1 | 8/2017 | Li | |

FOREIGN PATENT DOCUMENTS

| | | | |
|---|---|---|---|
| CN | 103439816 | A | 12/2013 |
| CN | 105044960 | A | 11/2015 |

OTHER PUBLICATIONS

Chinese language office action dated Aug. 3, 2020, issued in application No. CN 201810146977.2.

* cited by examiner

LIQUID-CRYSTAL ANTENNA DEVICE AND MANUFACTURING METHOD OF THE SAME

CROSS REFERENCE TO RELATED APPLICATIONS

This application claims priority of U.S. Provisional Patent Application No. 62/542,369, filed on Aug. 8, 2017 and Chinese Patent Application No. 201810146977.2, filed on Feb. 12, 2018, the entirety of which is incorporated by reference herein.

BACKGROUND

Technical Field

The present disclosure relates to a manufacturing method of a liquid-crystal antenna device and a liquid-crystal antenna device manufactured by the method.

Description of the Related Art

Liquid-crystal molecules can possess both solid and liquid physical properties at the same time, and they have special optical properties and are sensitive to electromagnetic fields. Therefore, liquid-crystal molecules are widely used in various display devices. In recent years, liquid-crystal molecules have also been applied in tunable microwave devices, such as a liquid-crystal antenna device.

Specifically, a liquid-crystal antenna device can generate different dielectric coefficients by adjusting the electric field to control the rotation direction of the liquid-crystal molecules, which possess the characteristics of dual-dielectric coefficients. The liquid-crystal antenna device can control the arrangement of liquid-crystal molecules in each liquid-crystal antenna unit via an electrical signal so as to alter the dielectric parameter of each liquid-crystal antenna unit. Therefore, the phase or amplitude of the microwave signal in the liquid-crystal antenna device can be controlled so as to adjust the radiation direction of the microwave signal.

However, the requirement of the liquid-crystal antenna device on the injection amount of liquid-crystal molecules is stricter than the conventional liquid-crystal display. The liquid-crystal molecules are slowly absorbed into the device through the capillary principle in the traditional liquid-crystal injection method. The traditional liquid-crystal injection method is more time-consuming and may waste more liquid-crystal materials.

On the other hand, the rectangular layout is mostly used for alignment, bonding, assembly and cutting of the traditional liquid-crystal substrates. Although the cutting process can be simplified, the utilization rate of the substrate is not satisfactory.

Therefore, developing a method that can further improve the manufacturing quality and efficiency of the liquid-crystal antenna device is still one of the topics that the industry is devoted to researching.

SUMMARY

In accordance with some embodiments of the present disclosure, a method for manufacturing a liquid-crystal antenna device is provided. The method includes the following steps: (a) providing a first mother substrate, the first mother substrate includes a first region and a second region, the first region has a plurality of first sides, wherein an extension line of at least one of the plurality of first sides divides the second region into a first part and a second part: (b) forming a first electrode layer on the first region and the second region; and (c) cutting the first mother substrate along the plurality of first sides of the first region.

In accordance with some embodiments of the present disclosure, a method for manufacturing a liquid-crystal antenna device is provided. The method includes the following steps: (a) providing a first mother substrate, the first mother substrate includes a first region, and the first region has a plurality of first sides; (b) forming a first electrode layer on the first region; (c) disposing a first sealing member on the first region of the first mother substrate to define an active area; (d) dripping a liquid-crystal molecule in the active area; (e) providing a second mother substrate, wherein the first sealing member is disposed between the first mother substrate and the second mother substrate; and (f) cutting the first region of the first mother substrate and the second mother substrate along the plurality of first sides of the first region.

In accordance embodiments of the present disclosure, a liquid-crystal antenna device is provided. The liquid-crystal antenna device includes a first substrate having a plurality of first sides; a second substrate disposed opposite to the first substrate; a first electrode layer disposed on the first substrate; a second electrode layer disposed on the second substrate; a first sealing member disposed between the first substrate and the second substrate, and the first sealing member, the first substrate and the second substrate define an active area; a liquid-crystal layer filled into the active area; and a second sealing member, wherein a part of the second sealing member protrudes from one of the plurality of first sides, and the second sealing member connects to the first sealing member.

A detailed description is given in the following embodiments with reference to the accompanying drawings.

BRIEF DESCRIPTION OF THE DRAWINGS

The disclosure may be more fully understood by reading the subsequent detailed description and examples with references made to the accompanying drawings, wherein.

DETAILED DESCRIPTION

Figure 1:
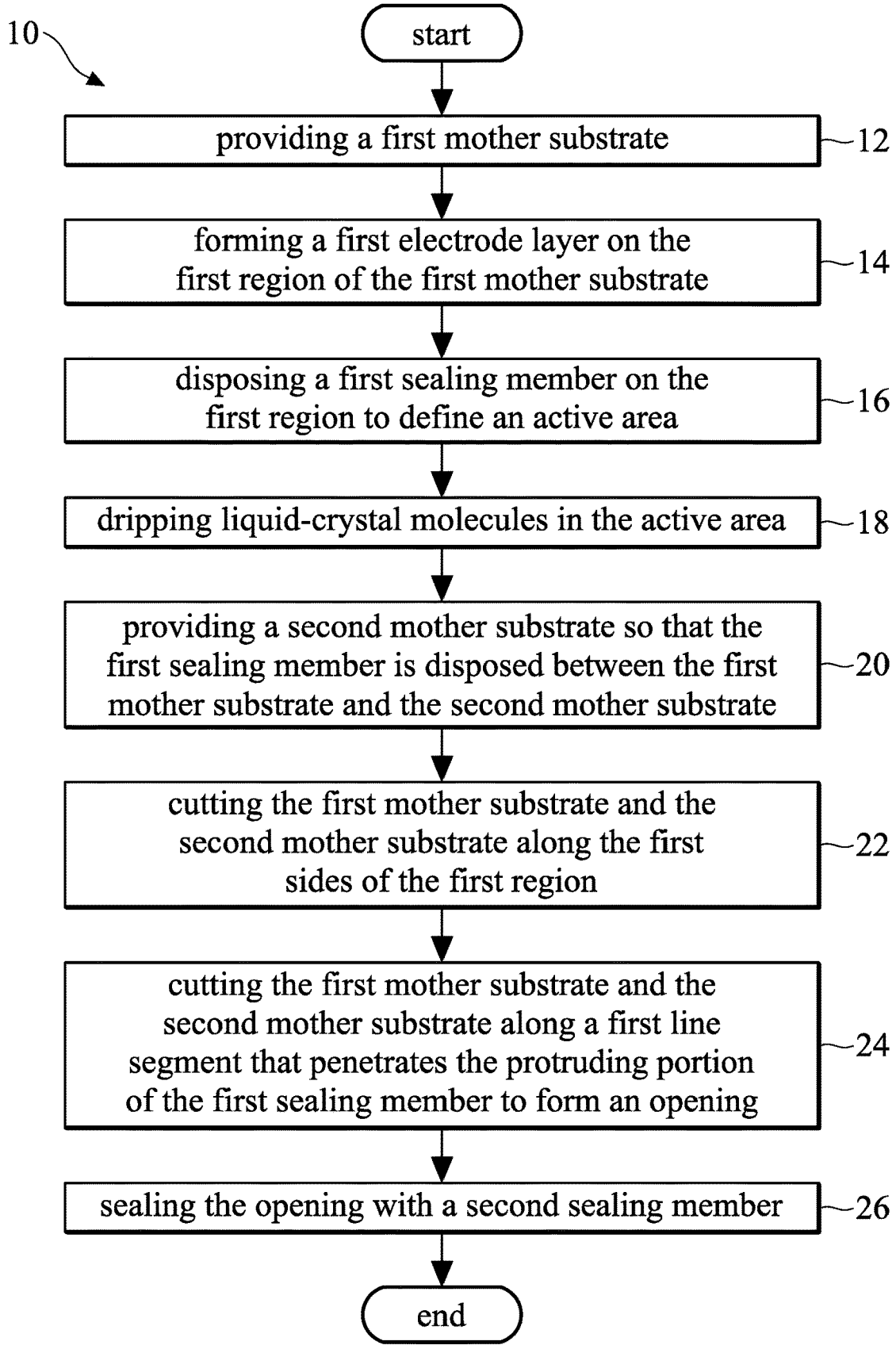
FIG. 1 illustrates a flowchart of a manufacturing method of a liquid-crystal antenna device in accordance with some embodiments of the present disclosure.

The manufacturing method of a liquid-crystal antenna device of the present disclosure and the liquid-crystal antenna device manufactured by the method are described in detail in the following description. In the following detailed description, for purposes of explanation, numerous specific details and embodiments are set forth in order to provide a thorough understanding of the present disclosure. The specific elements and configurations described in the following detailed description are set forth in order to clearly describe the present disclosure. It will be apparent, however, that the exemplary embodiments set forth herein are used merely for the purpose of illustration, and the inventive concept may be embodied in various forms without being limited to those exemplary embodiments. In addition, the drawings of different embodiments may use like and/or corresponding numerals to denote like and/or corresponding elements in order to clearly describe the present disclosure. However, the use of like and/or corresponding numerals in the drawings of different embodiments does not suggest any correlation between different embodiments. In addition, in this specification, expressions such as "first material layer disposed on/over a second material layer", may indicate the direct contact of the first material layer and the second material layer, or it may indicate a non-contact state with one or more intermediate layers between the first material layer and the second material layer. In the above situation, the first material layer may not be in direct contact with the second material layer.

It should be noted that the elements or devices in the drawings of the present disclosure may be present in any form or configuration known to those with ordinary skill in the art. In addition, the expressions "a layer overlying another layer", "a layer is disposed above another layer", "a layer is disposed on another layer" and "a layer is disposed over another layer" may indicate that the layer is in direct contact with the other layer, or that the layer is not in direct contact with the other layer, there being one or more intermediate layers disposed between the layer and the other layer.

In addition, in this specification, relative expressions are used. For example, "lower", "bottom", "higher" or "top" are used to describe the position of one element relative to another. It should be appreciated that if a device is flipped upside down, an element that is "lower" will become an element that is "higher".

It should be understood that, although the terms first, second, third etc. may be used herein to describe various elements, components, regions, layers, parts and/or sections, these elements, components, regions, layers, parts and/or sections should not be limited by these terms. These terms are only used to distinguish one element, component, region, layer, part or section from another region, layer or section. Thus, a first element, component, region, layer, part or section discussed below could be termed a second element, component, region, layer, part or section without departing from the teachings of the present disclosure.

It should be understood that this description of the exemplary embodiments is intended to be read in connection with the accompanying drawings, which are to be considered part of the entire written description. The drawings are not drawn to scale. In addition, structures and devices are shown schematically in order to simplify the drawing.

The terms "about" and "substantially" typically mean +/−20% of the stated value, more typically +/−10% of the stated value, more typically +/−5% of the stated value, more typically +/−3% of the stated value, more typically +/−2% of the stated value, more typically +/−1% of the stated value and even more typically +/−0.5% of the stated value. The stated value of the present disclosure is an approximate value. When there is no specific description, the stated value includes the meaning of "about" or "substantially".

Unless defined otherwise, all technical and scientific terms used herein have the same meaning as commonly understood by one of ordinary skill in the art to which this disclosure belongs. It should be appreciated that, in each case, the term, which is defined in a commonly used dictionary, should be interpreted as having a meaning that conforms to the relative skills of the present disclosure and the background or the context of the present disclosure, and should not be interpreted in an idealized or overly formal manner unless so defined.

In addition, in some embodiments of the present disclosure, terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The manufacturing method of the liquid-crystal antenna device provided by the present disclosure may control the injection amount of the liquid-crystal more accurately and further improve the problem of the liquid-crystal cell gap so as to improve the performance of the liquid-crystal antenna device. In addition, compared with the conventional liquid-crystal injection method that utilizes the capillary principle, the manufacturing method of the liquid-crystal antenna device of the present disclosure may greatly shorten the manufacturing time and improve the manufacturing efficiency.

In addition, the present disclosure also provides various aspects of the arrangement of liquid-crystal antenna devices on the mother substrate during the manufacturing process. By using the method of staggered arrangement, the utilization rate of the mother substrate may also be improved efficiently.

FIG. 1 illustrates a flowchart of a manufacturing method of a liquid-crystal antenna device 10 in accordance with some embodiments of the present disclosure. It should be understood that additional operations may be provided before, during, and after the processes of the manufacturing method of a liquid-crystal antenna device 10 in some embodiments of the present disclosure. In some embodiments of the present disclosure, some of the operations described below may be replaced or eliminated. In some embodiments of the present disclosure, the order of the operations/processes may be interchangeable. Additional features may be added to the liquid-crystal antenna device in accordance with some embodiments. In some other embodiments of the present disclosure, some of the features of the liquid-crystal antenna device described below may be replaced or eliminated. FIGS. 2A-2G illustrate the top views of a liquid-crystal antenna device 200 formed in the intermediate stages of the manufacturing method of a liquid-crystal antenna device 10 as shown in FIG. 1 in accordance with some embodiments of the present disclosure.

Figure 2A:
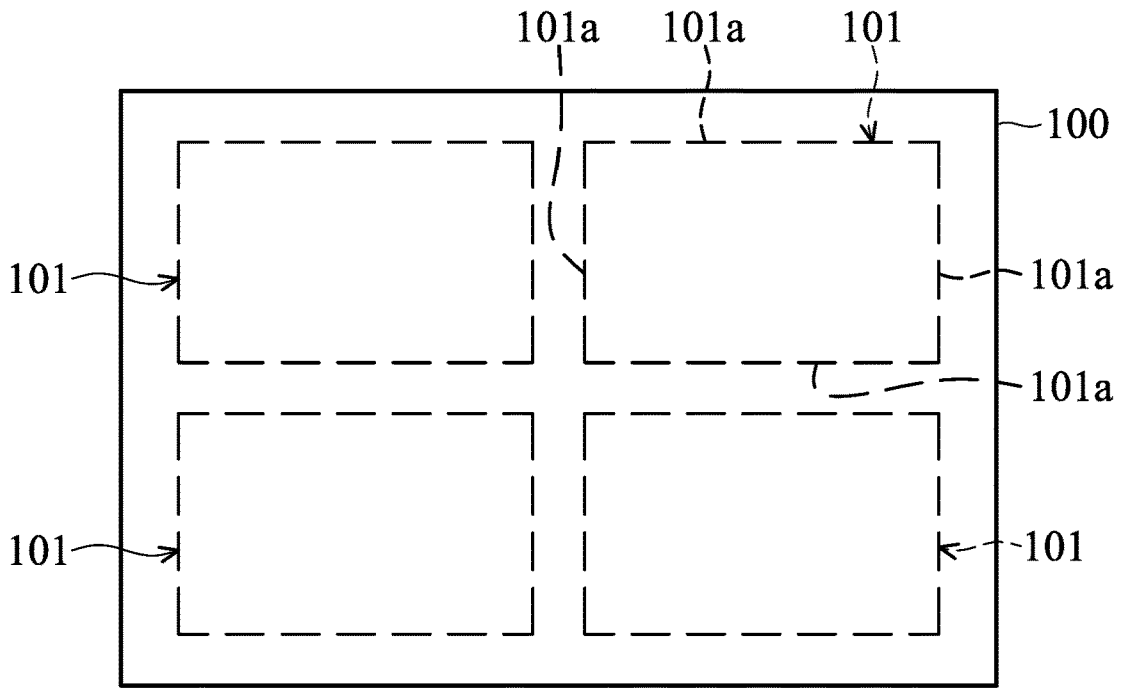
FIGS. 2A-2G illustrate the top views of the liquid-crystal antenna device formed in the intermediate stages of the manufacturing method of a liquid-crystal antenna device as shown in FIG. 1 in accordance with some embodiments of the present disclosure.

First, referring to FIG. 1 and FIG. 2A, the manufacturing method of the liquid-crystal antenna device 10 starts from step 12. A first mother substrate 100 is provided in step 12. As shown in FIG. 2A, the first mother substrate 100 may include a plurality of first regions 101. The first region 101 has a plurality of first sides 101*a*. A plurality of liquid-crystal antenna devices may be manufactured simultaneously on the first mother substrate 100, and each first region 101 corresponds to one liquid-crystal antenna device.

In some embodiments, the material of the first mother substrate 100 may include, but is not limited to, glass, polyimide (PI), liquid-crystal polymers (LCP), or a combination thereof. The first mother substrate 100 may be formed of rigid substances or elastic substances. In addition, it should be understood that although the shape of the first region 101 is rectangular in the embodiment shown in FIG. 2A, the first region 101 may have other shapes in other embodiments, which will be further described with reference to FIG. 5A to FIG. 8.

Figure 4:
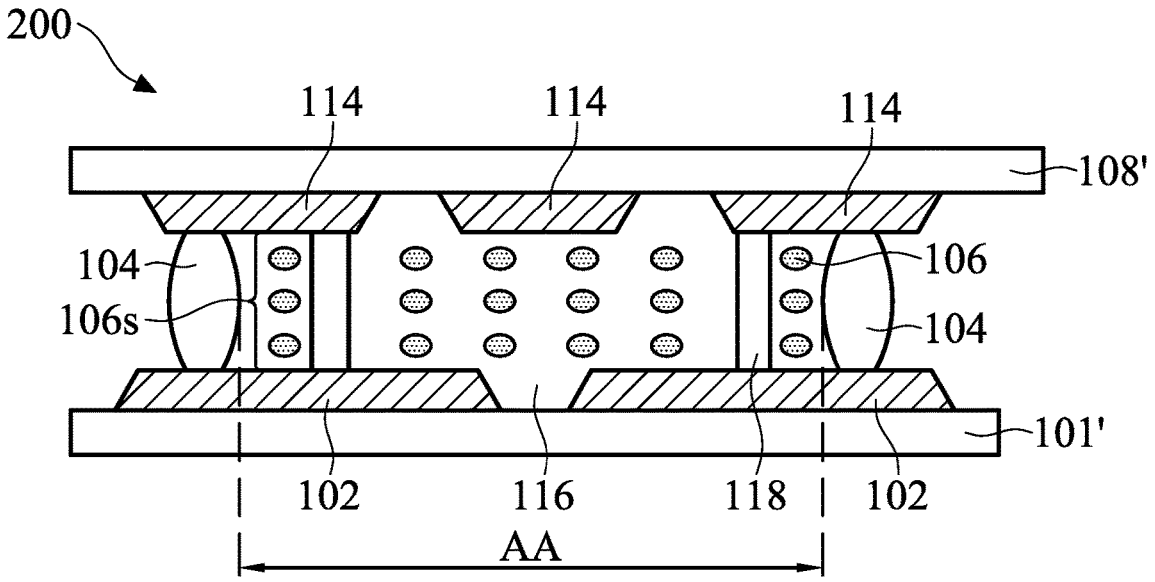
FIG. 4 illustrates a cross-sectional view of the liquid-crystal antenna device along the line segment B-B' in FIG. 2G.

Next, referring FIG. 1, in step 14, a first electrode layer 102 (as shown in FIG. 4) is formed in the first region 101 of the first mother substrate 100. It should be understood that the first electrode layer 102 is omitted in FIGS. 2B-2G and 4 in order to clearly explain the present disclosure. The first electrode layer 102 may be formed of metallic conductive materials. In some embodiments, the material of the first electrode layer 102 may include, but is not limited to, copper, aluminum, molybdenum, tungsten, gold, chromium, nickel, platinum, copper alloy, aluminum alloy, molybdenum alloy, tungsten alloy, gold alloy, chromium alloy, nickel alloy, platinum alloy, any other suitable conductive materials, or a combination thereof.

The first electrode layer 102 may be formed by using one or more deposition, photolithography and etching processes. In some embodiments, the deposition process may include, but is not limited to, a chemical vapor deposition process, a physical vapor deposition process, an electroplating process, an electroless plating process, any other suitable processes, or a combination thereof. The chemical vapor deposition may include, but is not limited to, low-pressure chemical vapor deposition (LPCVD), low-temperature chemical vapor deposition (LTCVD), rapid thermal chemical vapor deposition (RTCVD), plasma enhanced chemical vapor deposition (PECVD), atomic layer deposition (ALD), or any other suitable method. The physical vapor deposition process may include, but is not limited to, sputtering, evaporation, pulsed laser deposition (PLD), or any other suitable processes. In addition, in some embodiments, the photolithography process may include, but is not limited to, photoresist coating (e.g., spin-on coating), soft baking, hard baking, mask aligning, exposure, post-exposure baking, developing the photoresist, rinsing, drying, or any other suitable processes. The etching process may include dry etching process, wet etching process, or any other suitable etching processes.

Figure 2B:
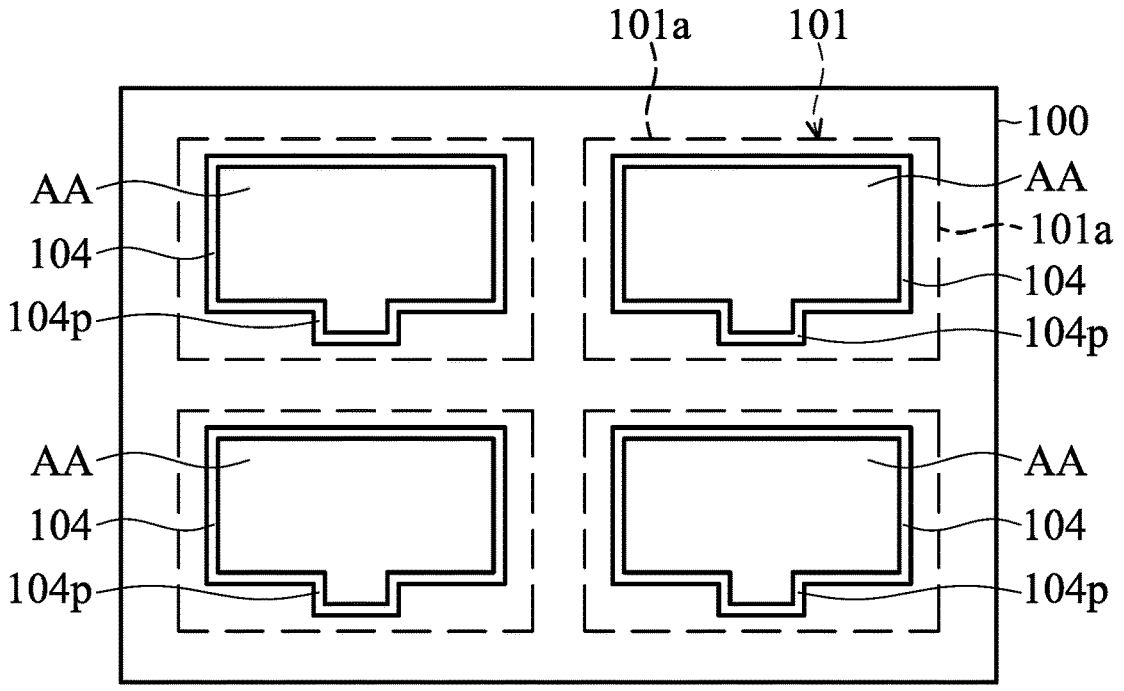

Next referring to FIG. 1 and FIG. 2B, in step 16, a first sealing member 104 is disposed over the first region 101 of the first mother substrate 100 to define an active area AA of the liquid-crystal antenna device. In other words, the first sealing member 104 surrounds the active area AA. The first sealing member 104 also covers a part of the first electrode layer 102 in accordance with some embodiments.

The first sealing member 104 may be formed of adhesive materials. The first mother substrate 100 and a second mother substrate 108 (as shown in FIG. 2D) may be assembled by the first sealing member 104 so as to prevent the liquid-crystal molecules, which will be filled subsequently, from flowing out. The first sealing member 104 may include, but is not limited to, sealant glue, glue dots, any other suitable materials, or a combination thereof. The first sealing member 104 may be formed of a single material or composite materials of the following materials. For example, the material of the first sealing member 104 may include, but is not limited to, polyethylene terephthalate (PET), polyethylene (PE), polyethersulfone (PES), polycarbonate (PC), polymethylmethacrylate (PMMA), epoxy, glass, any other suitable materials, or a combination thereof. In some embodiments, the first sealing member 104 may be a photo-curing or thermal curing sealant. For example, the first sealing member 104 may be a photo-curing sealant (UV light or general visible light), a thermal curing sealant, or a photothermal curing sealant. In addition, in some embodiments, the first sealing member 104 may be formed by coating, spraying, screen printing, any other suitable methods, or a combination thereof, but it is not limited thereto.

It should be noted that the first sealing member 104 includes a protruding part 104*p* in accordance with some embodiments. As shown in FIG. 2B, the protruding part 104*p* is located within the first region 101, and the protruding part 104*p* is adjacent to at least one of the first sides 101*a* of the first region 101. The projection of the protruding part 104*p* is located within the first region 101. More specifically, the projection of the protruding part 104*p* on the first mother substrate 100 is located within the first region 101. Although the protruding part 104*p* is provided in a shape similar to "⌐" in the embodiment shown in FIG. 2B, the protruding part 104*p* may have any other suitable shapes in some other embodiments. For example, the protruding part 104*p* may have a shape similar to "inverted U" in some other embodiment, but is it not limited thereto. In addition, although the first sealing member 104 other than the protruding part 104*p* is substantially rectangular in the embodiment shown in FIG. 2B, the shape of the first sealing member 104 is not limited thereto and may be adjusted according to needs. For example, in some embodiments, the first sealing member 104 other than the protruding part 104*p* is substantially circular, semicircular, ¼ circular, triangular, hexagonal, octagonal, decagonal, dodecagonal or any other suitable shapes.

Figure 2C:
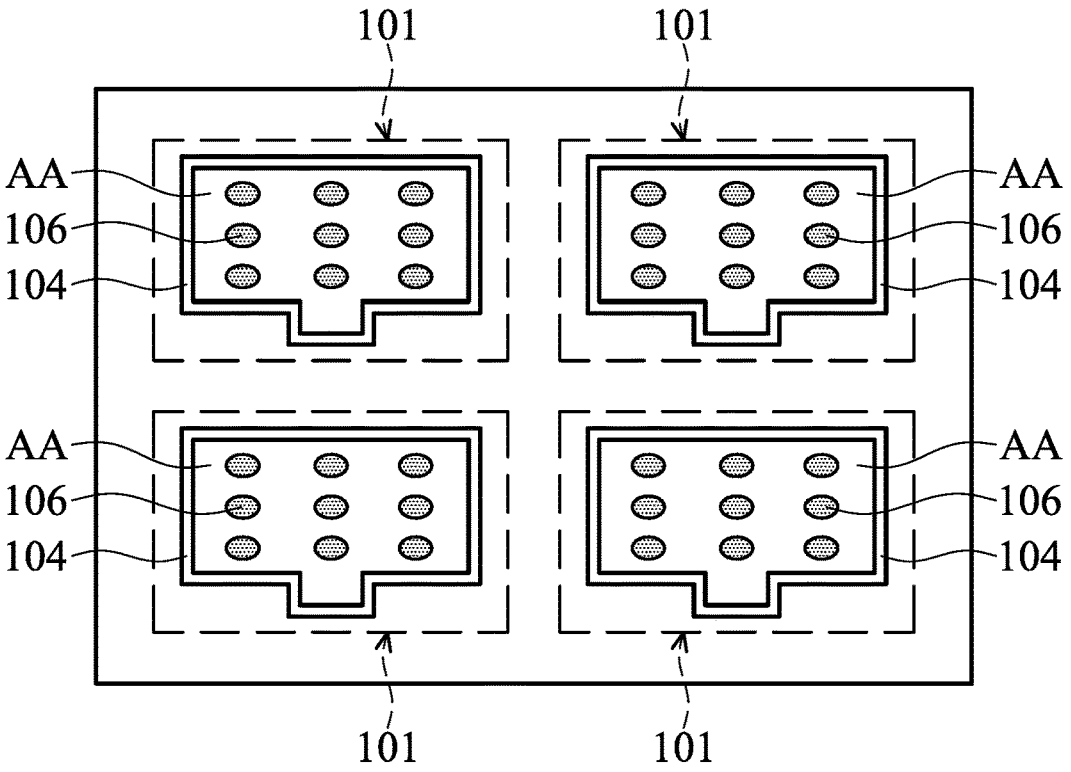
Figure 2D:
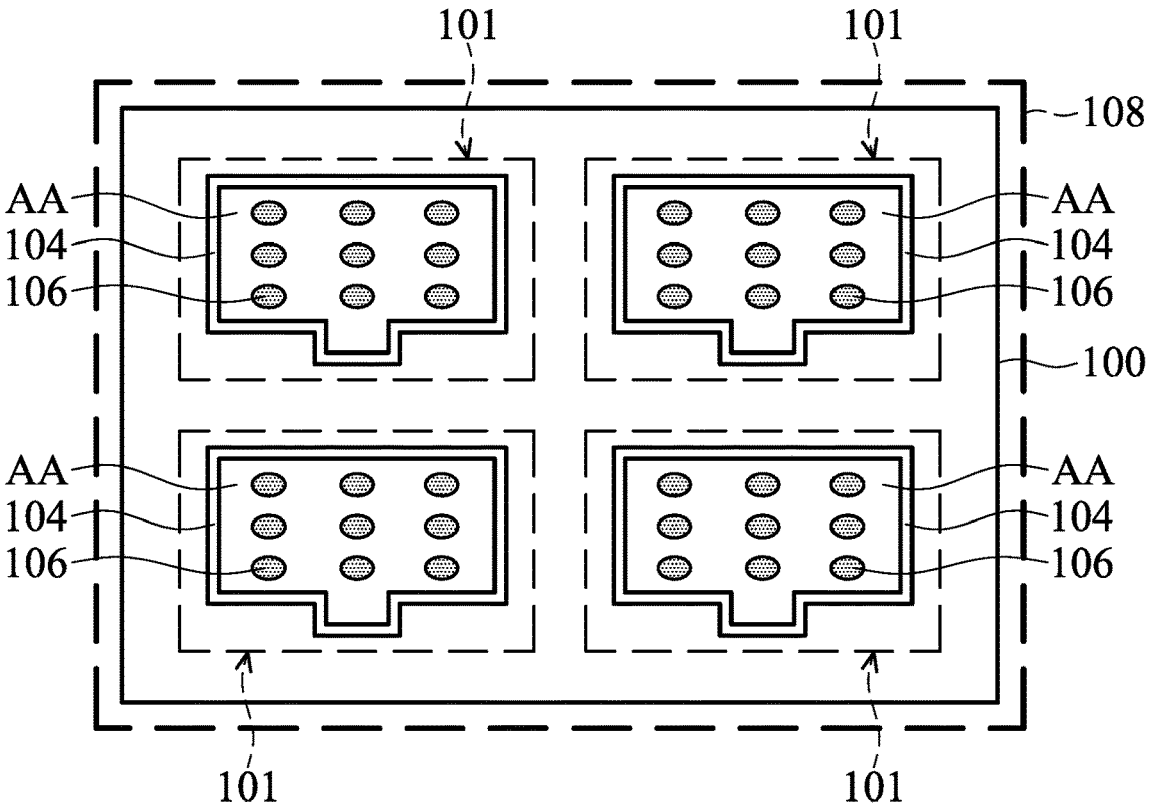

Next, referring to FIG. 1 and FIG. 2C, in step 18, the liquid-crystal molecules 106 are dripped in the active area AA. The liquid-crystal molecules 106 may be dripped into the active area AA surrounded by the first sealing member 104 by a liquid-crystal dispensing apparatus. The amount of the liquid-crystal molecules 106 that is dripped may be adjusted according to the requirement of the liquid-crystal antenna device. In particular, in some embodiments, the amount of liquid-crystal molecules 106 that is dripped may be slightly more than the estimated required amount. Since the slight excess of liquid-crystal molecules 106 can be discharged through the openings formed at the protruding part 104*p* in the subsequent step, an optimum amount of liquid-crystal may be achieved or the gaps of liquid-crystal may be reduced.

Next, referring to FIG. 1 and FIG. 2D, in step 20, a second mother substrate 108 is provided. The second mother substrate 108 covers the first mother substrate 100 so that the first sealing member 104 is disposed between the first mother substrate 100 and the second mother substrate 108. The first sealing member 104 connects the first mother substrate 100 to the second mother substrate 108. As described above, the first mother substrate 100 and the second mother substrate 108 can be assembled by the first sealing member 104.

In some embodiments, the material of the second mother substrate 108 may include, but is not limited to, glass, polyimide (PI), liquid-crystal polymers (LCP) or a combination thereof. The material of the first mother substrate 100 is the same as that of the second mother substrate 108 in accordance with some embodiments. The material of the first mother substrate 100 is different from that of the second mother substrate 108 in accordance with some other embodiments.

Moreover, the size of the second mother substrate 108 is larger than the size of the first mother substrate 100 in the embodiment shown in FIG. 2D. However, it should be understood that this illustration is only for the purpose to clearly distinguish the first mother substrate 100 from the second mother substrate 108. In fact, the first mother substrate 100 and the second mother substrate 108 may have the same or different sizes according to needs. For example, in some embodiments, a second substrate 108' (not illustrated) may be provided. The second substrate 108' may have substantially the same size and shape as the first region 101, and a plurality of second substrates 108' may be disposed corresponding to a plurality of first regions 101 of the first mother substrate 100 respectively. In addition, the second mother substrate 108 is omitted in FIGS. 2E to 2G for clarity.

Additionally, a second electrode layer 114 may be formed on a side of the second mother substrate 108 that is close to the first mother substrate 100 (as shown in FIG. 4). The second electrode layer 114 may be formed of metallic conductive materials. In some embodiments, the material of the second electrode layer 114 may include, but is not limited to, copper, aluminum, molybdenum, tungsten, gold, chromium, nickel, platinum, copper alloy, aluminum alloy, molybdenum alloy, tungsten alloy, gold alloy, chromium alloy, nickel alloy, platinum alloy, any other suitable conductive materials, or a combination thereof.

The second electrode layer 114 may be formed by using one or more deposition, photolithography and etching processes. In some embodiments, the deposition process may include, but is not limited to, a chemical vapor deposition process, a physical vapor deposition process, an electroplating process, an electroless plating process, any other suitable processes, or a combination thereof. The chemical vapor deposition may include, but is not limited to, low-pressure chemical vapor deposition (LPCVD), low-temperature chemical vapor deposition (LTCVD), rapid thermal chemical vapor deposition (RTCVD), plasma enhanced chemical vapor deposition (PECVD), atomic layer deposition (ALD), or any other suitable method. The physical vapor deposition process may include, but is not limited to, sputtering, evaporation, pulsed laser deposition (PLD), or any other suitable processes. In addition, in some embodiments, the photolithography process may include, but is not limited to, photoresist coating (e.g., spin-on coating), soft baking, hard baking, mask aligning, exposure, post-exposure baking, developing the photoresist, rinsing, drying, or any other suitable processes. The etching process may include dry etching process, wet etching process, or any other suitable etching processes.

Figure 2E:
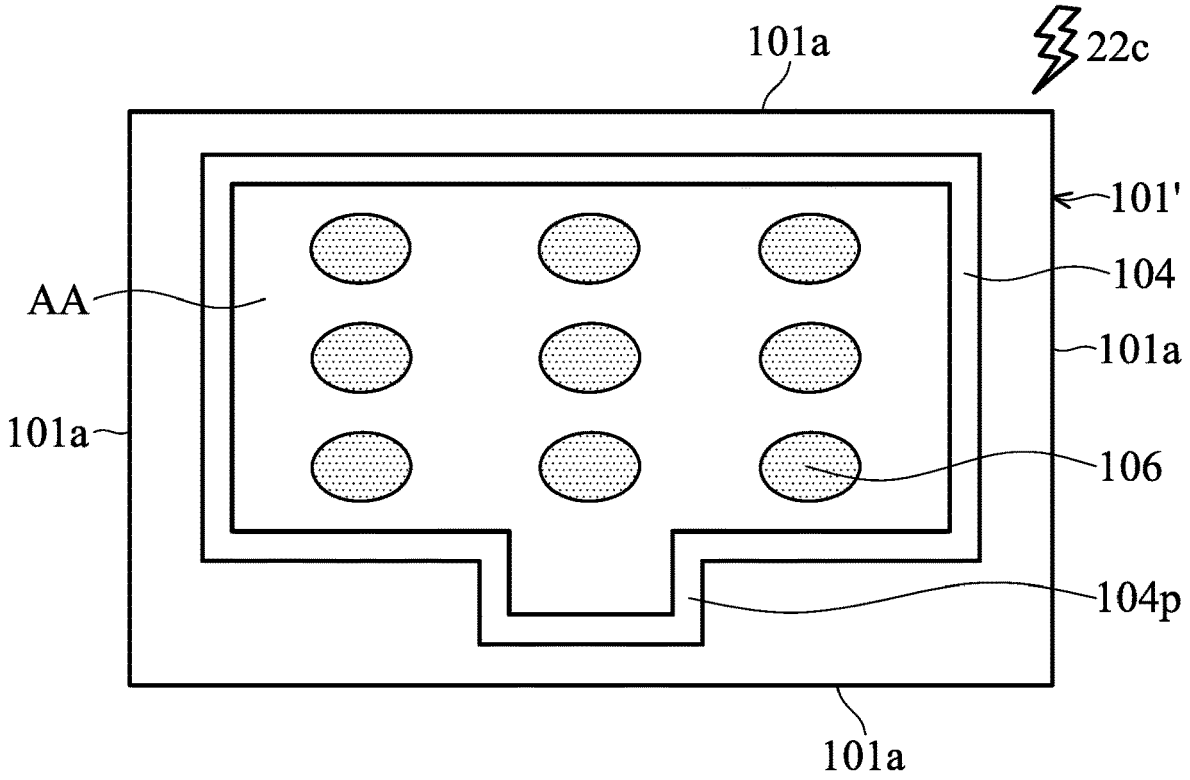

After the alignment and assembly of the first mother substrate 100 and the second mother substrate 108 are completed, referring to FIG. 1 and FIG. 2E, the first cutting process 22*c* is performed in step 22. The first mother substrate 100 and the second mother substrate 108 are cut along the first sides 101*a* of the first region 101 in the first cutting process 22*c*. As shown in FIG. 2E, after the first cutting process 22*c*, the protruding part 104*p* is still complete and located in the first region 101. In other words, the protruding part 104*p* is not cut in the first cutting process 22*c* in accordance with this embodiment.

In some embodiments, the first cutting process 22*c* may include, but is not limited to, a mechanical cutting process, a laser cutting process, any other suitable cutting processes, or a combination thereof. In addition, the first mother substrate 100 and the second mother substrate 108 may be cut by the same cutting process in accordance with some embodiments. For example, both the first mother substrate 100 and the second mother substrate 108 may be cut by the first cutting process 22*c*. In some other embodiments, the first mother substrate 100 and the second mother substrate 108 may be cut by different cutting processes, and the second mother substrate 108 may be cut to form the second substrate 108' that corresponds to the first region 101 (not illustrated). On the other hand, in some embodiments, after the first cutting process 22*c* is performed, the first region 101 is defined as the first substrate 101'. The sidewalls of the first substrate 101' are substantially aligned with the sidewalls of the second substrate 108'. However, in some other embodiments, after the first cutting process 22*c* is performed, the size of the first substrate 101' is different from the size of the second substrate 108'. That is, the sidewalls of the first substrate 101' and the sidewalls of the second substrate 108' may be not aligned with each other.

Figure 2F:
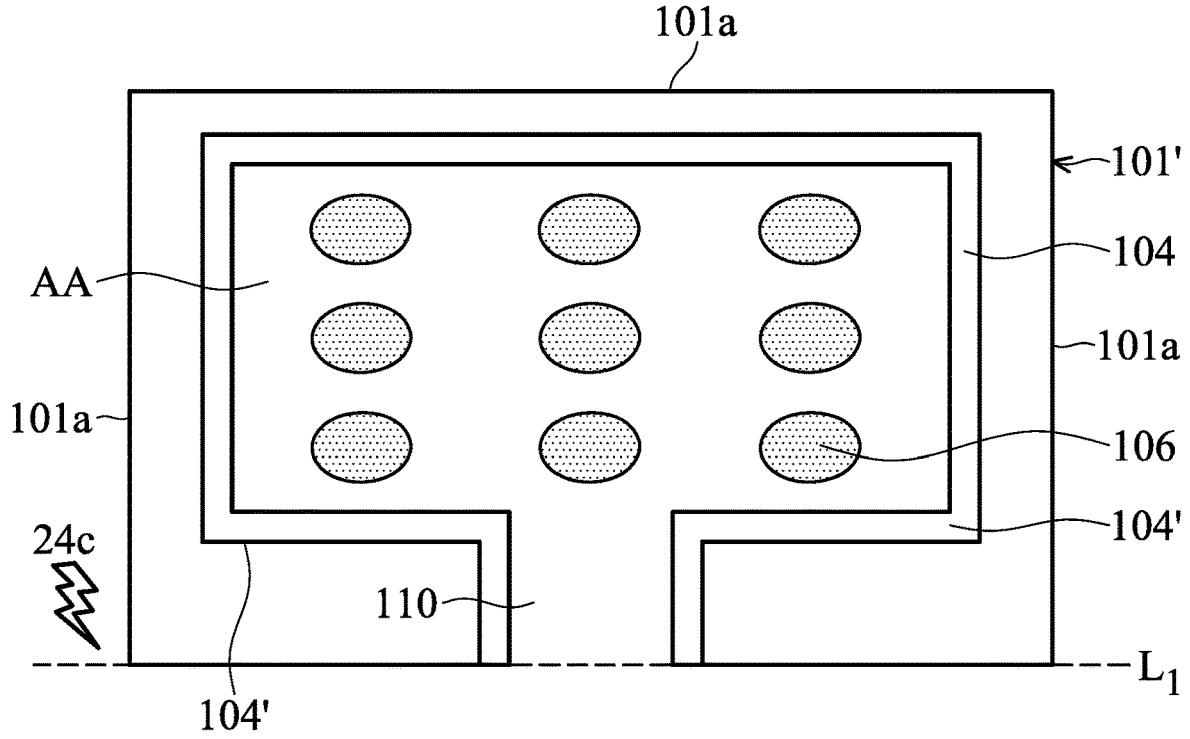

Next, referring to FIG. 1 and FIG. 2F, a second cutting process 24*c* is performed in step 24. The first substrate 101' and the second substrate 108' are cut along a first line segment $L_1$ that penetrates the protruding part 104*p* to form an opening 110 in the second cutting process 24*c*. That is, a part of the protruding part 104*p* is cut off in the second cutting process 24*c*. The first line segment $L_1$ may be any line segment that penetrates through the protruding part 104*p* and form an opening at the protruding part 104*p*.

As described above, the second cutting process 24*c* may include, but is not limited to, a mechanical cutting process, a laser cutting process, any other suitable cutting processes, or a combination thereof.

Next, in some embodiments, after step 24, excess liquid-crystal molecules 106 in the active region AA may be discharged through the opening 110. Accordingly, the resulting liquid-crystal antenna device may have an optimum amount of liquid crystal. In some embodiments, the liquid-crystal molecules 106 can be discharged through the opening 110 by the way of squeezing, but it is not limited thereto.

Figure 2G:
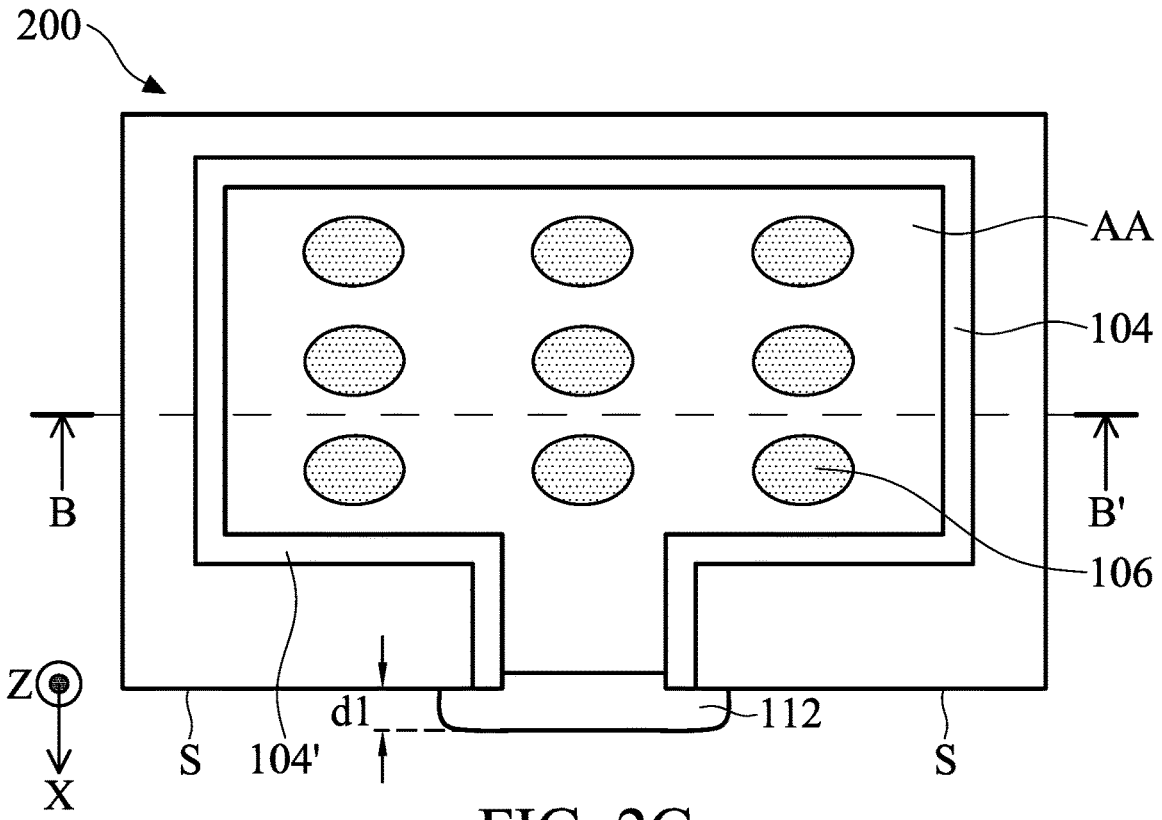

Next, referring to FIG. 1 and FIG. 2G, in step 26, the opening 110 is sealed with a second sealing member 112. In some embodiment, the second sealing member 112 may include, but is not limited to, sealant glue, glue dots, any other suitable materials, or a combination thereof. In some embodiments, the second sealing member 112 may be a photo-curing or thermal curing sealant. For example, the second sealing member 112 may be a photo-curing sealant (UV light or general visible light), a thermal curing sealant, or a photothermal curing sealant. In some embodiments, the second sealing member 112 may be formed of a single material or composite materials of the following materials. For example, the material of the second sealing member 112 may include, but is not limited to, polyethylene terephthalate (PET), polyethylene (PE), polyethersulfone (PES), polycarbonate (PC), polymethyl ethacrylate (PMMA), epoxy, glass, any other suitable materials, or a combination thereof. In some embodiments, the material of the second sealing member 112 is the same as the material of the first sealing member 104. In some embodiments, the material of the second sealing member 112 is different from the material of the first sealing member 104.

As shown in FIG. 2G, in the liquid-crystal antenna device 200 manufactured by the above method, a part of the second sealing member 112 protrudes from the sidewalls S of the first substrate 101' and the second substrate 108'. The sidewalls S are produced by the second cutting process 24*c*. In some embodiments, the second sealing member 112 protrudes from the sidewall S of the first substrate 101' or the sidewall of the second substrate 108' by a distance $d_1$, and the distance $d_1$ is in a range from about 0 mm to about 1 mm. In some embodiments, the second sealing member 112 may be filled at the opening first, and then the excess second sealing member 112 may be scraped off to make the second sealing member 112 protrude from the sidewall of first substrate 101' or the sidewall of the second substrate 108' by the distance $d_1$, which is in a range from about 0 mm to about 1 mm. In other words, the distance that the second sealing member 112 protrudes from the first line segment $L_1$ in a direction X is in a range from about 0 mm to about 1 mm. The direction X is substantially perpendicular to the normal direction (direction Z) of the first substrate 101'.

As described above, the manufacturing method of the liquid-crystal antenna device 10 includes two cutting processes, the first cutting process 22*c* and the second cutting process 24*c*. First, a slight excess of liquid-crystal molecules 106 are filled into the liquid-crystal antenna device 200 and the shape of the liquid-crystal antenna device 200 is roughly defined by the first cutting process 22*c*. Then, the excess liquid-crystal molecules 106 in the liquid-crystal antenna device 200 may be discharged by the second cutting process 24*c* so as to have the amount of liquid-crystal more optimized or reduce the generation of a liquid-crystal gap. In addition, the two cutting processes may control the cutting position of the opening for discharging the excess liquid crystal, and may further control the amount of liquid-crystal that is filled into the liquid-crystal antenna device 200.

Figure 3A:
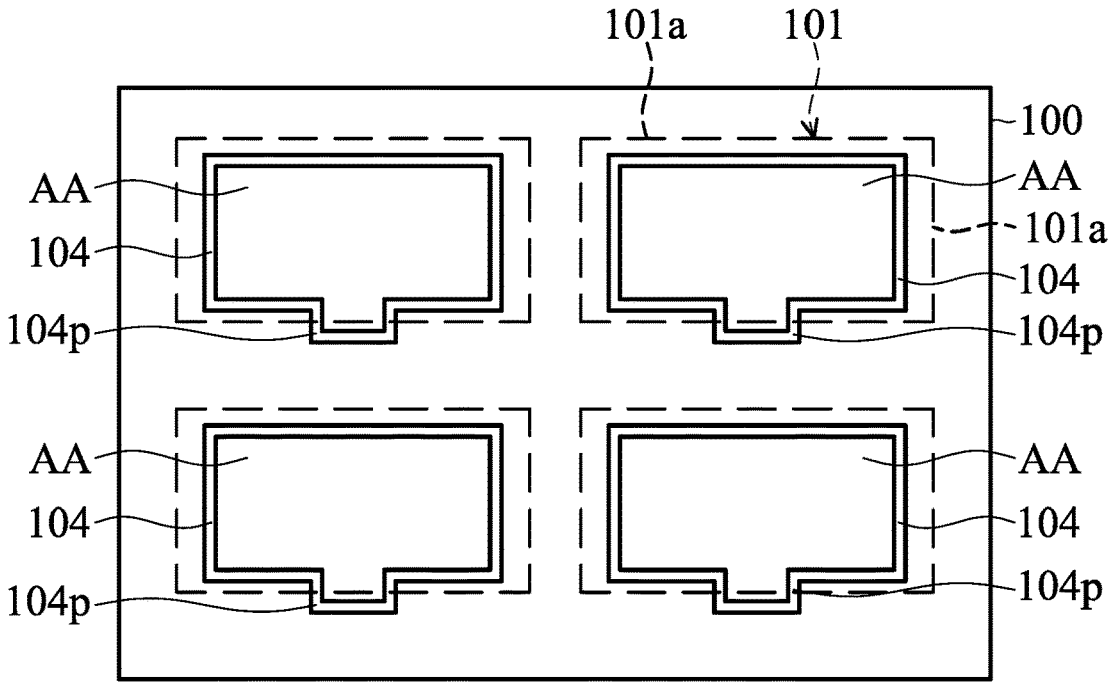
FIGS. 3A-3D illustrate the top views of the liquid-crystal antenna device formed in the intermediate stages of a manufacturing method of a liquid-crystal antenna device in accordance with some other embodiments of the present disclosure.
Figure 3B:
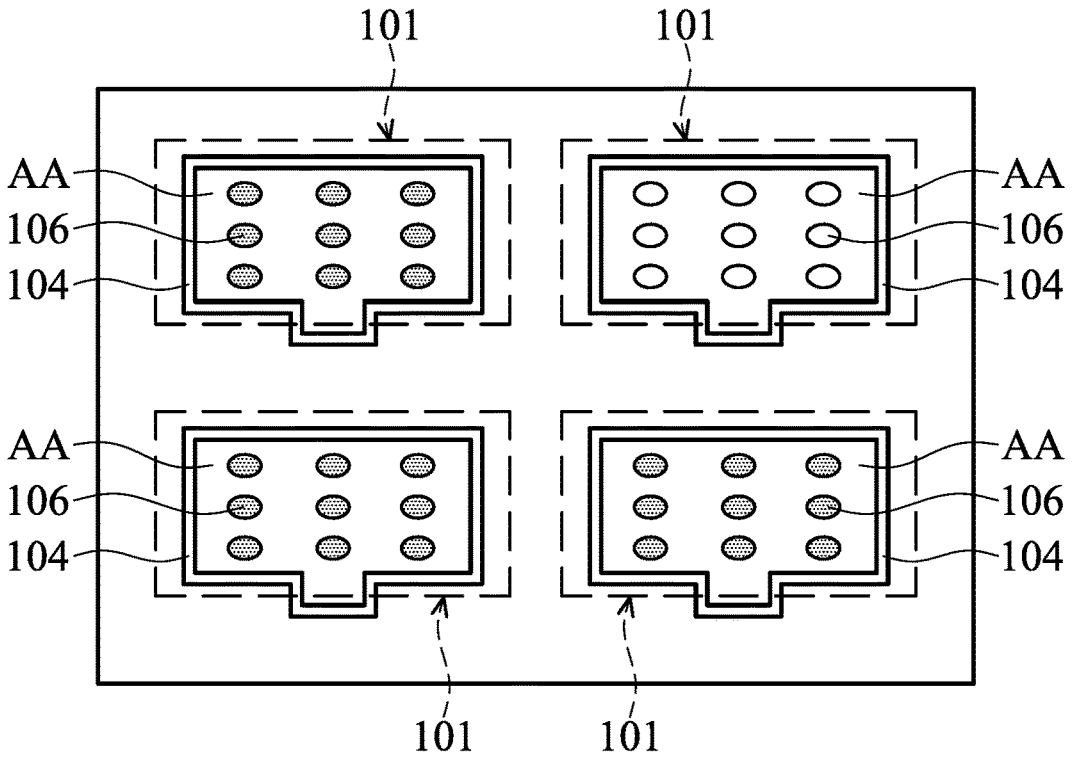
Figure 3C:
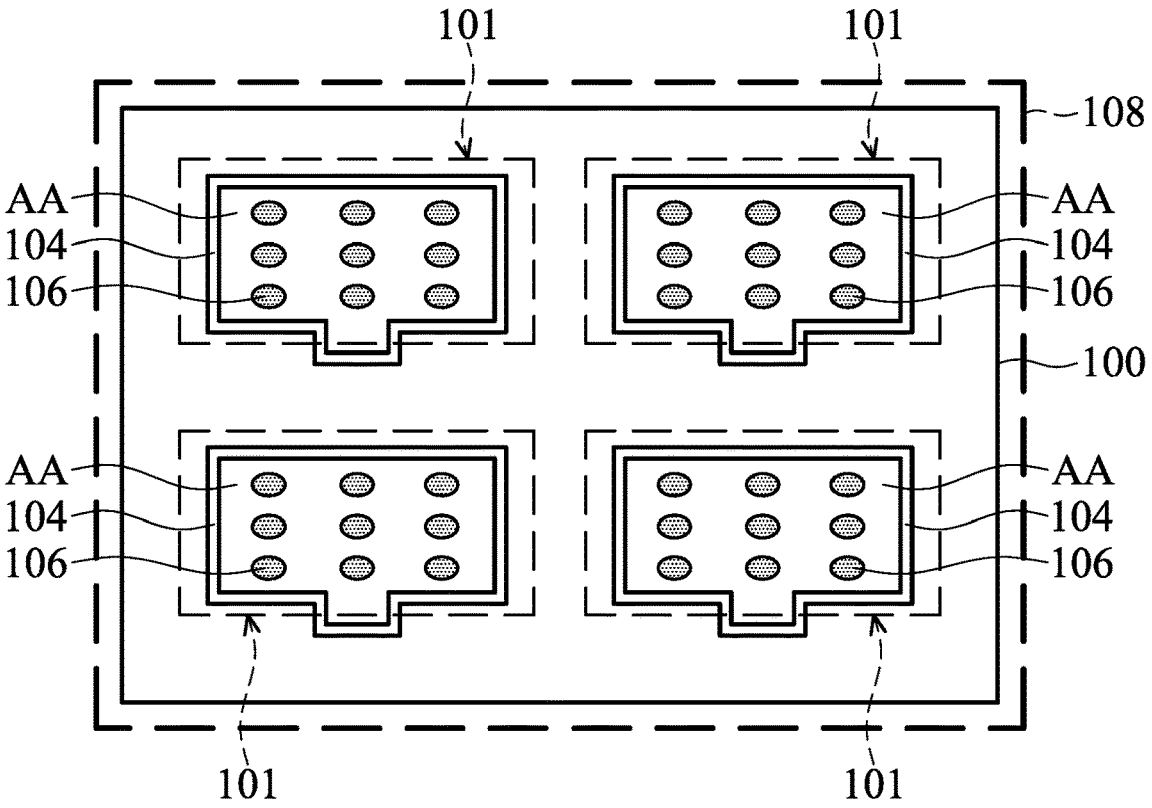
Figure 3D:
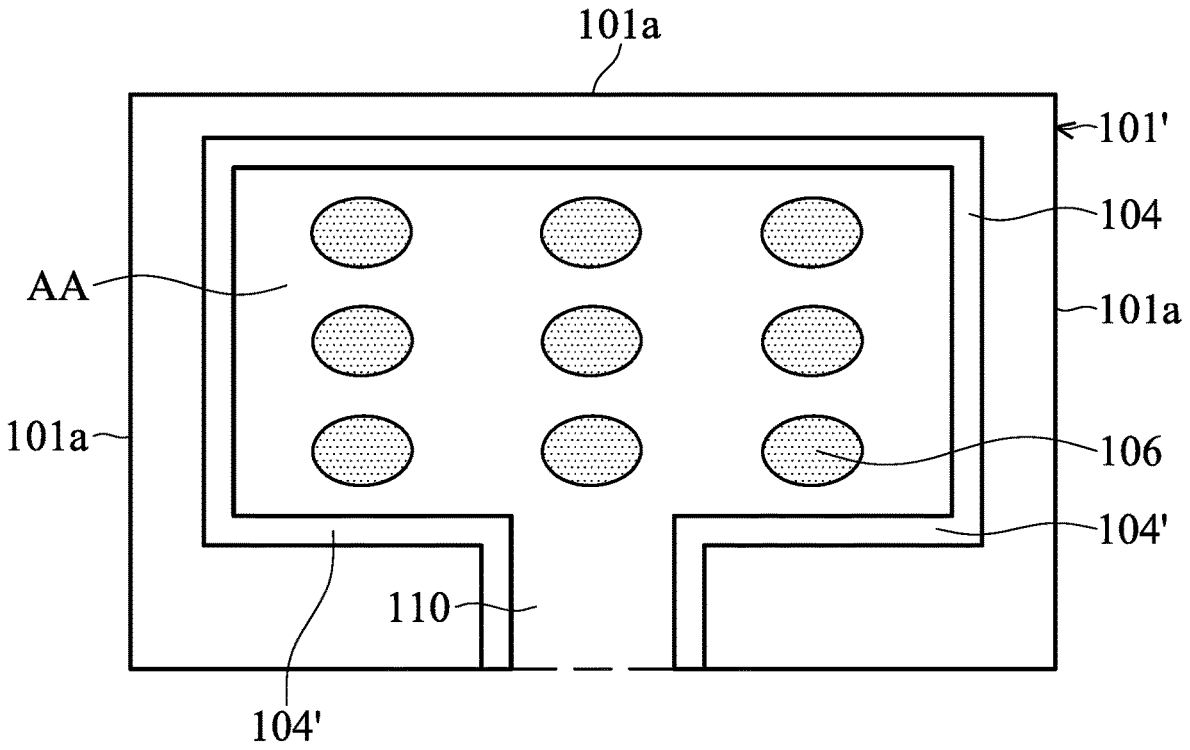

Referring to FIGS. 34-3D, FIGS. 3A-3D illustrate the top views of the liquid-crystal antenna device formed in the intermediate stages of a manufacturing method of a liquid-crystal antenna device 30 in accordance with some other embodiments of the present disclosure. First, referring to FIG. 3A, the difference between the embodiments shown in FIG. 34 and FIG. 2B is that a part of the protruding part 104*p* of the first sealing member 104 is located outside the first region 101 in FIG. 34. In this embodiment, the projection of the part of the protruding part 104*p* is located outside the first region 101. More specifically, the projection of the part of the protruding part 104*p* on the first mother substrate 100 is located outside the first region 101. In other words, at least partial projection of the protruding part 104*p* on the first mother substrate 100 is located outside the first region 101. The step shown in FIG. 3B is the same as that in FIG. 2C. The liquid-crystal molecules 106 are dripped in the active region AA enclosed by the first sealing member 104 in both FIG. 3B and FIG. 2C. The step shown in FIG. 3C is the same as those in FIG. 2D. The second mother substrate 108 is provided to cover the first mother substrate 100 and the first sealing member 104 is disposed between the first mother substrate 100 and the second mother substrate 108 in both FIG. 3C and FIG. 2D. The difference between FIG. 3D and FIG. 2E is that the protruding part 104*p* has already been cut in the first cutting process 22*c* in FIG. 3D since the first side 101*a* crosses the protruding part 104*p*. Accordingly, the second cutting process 24*c* may be omitted in this embodiment. The subsequent process is the same as that in step 26 and FIG. 2G, the excess liquid-crystal molecules 106 in the active region AA may be discharged through the opening 110 and then the opening 110 may be sealed with the second sealing member 112. The liquid-crystal antenna device 200 is substantially completed at this stage.

Next, referring to FIG. 4, FIG. 4 illustrates a cross-sectional view of the liquid-crystal antenna device 200 along the line segment B-B' in FIG. 2G. It should be understood that additional features may be added to the liquid-crystal antenna device 200 in accordance with some embodiments. In some embodiments, some of the features of the liquid-crystal antenna device 200 described below may be replaced or eliminated. In addition, the same or similar components or elements in above and below contexts are represented by the same or similar reference numerals. The materials, manufacturing methods and functions of these components or elements are the same or similar to those described above, and thus will not be repeated herein.

As shown in FIG. 4, the liquid-crystal antenna device 200 may include the tint substrate 101' and the second substrate 108' that is disposed opposite to the first substrate 101'. The liquid-crystal antenna device 200 may also include the first electrode layer 102, the second electrode layer 114, the first sealing member 104 and a liquid-crystal layer 106*s*. The first electrode layer 102 is disposed on the first substrate 101'. As described above, the first electrode layer 102 may be patterned by photolithography, etching processes, and so on. In some embodiments, the patterned first electrode layer 102 may have an opening 116.

Moreover, the second electrode layer 114 may be disposed on the second substrate 108', and the second electrode layer 114 may also be patterned by photolithography, etching process, and so on. In some embodiments, the patterned second electrode layer 114 includes a plurality of parts that are separated from each other, and at least a part thereof corresponds to the opening 116 of the first electrode layer 102.

In some embodiments, the first electrode layer 102 or the second electrode layer 114 may be electrically connected to a corresponding functional circuit (not illustrated). In some embodiments, the functional circuit may be disposed on the second substrate 108' and may be located outside the active area AA that is defined by the first sealing member 104. Specifically, the functional circuit may apply a voltage to the second electrode layer 114 to Change the electric field between the second electrode layer 114 and the first electrode layer 102 and therefore change the arrangement direction (refractive index) of the quid-crystal molecules 106 that are disposed between the second electrode layer 114 and the first electrode layer 102. On the other hand, the functional circuit may also apply another voltage to the second electrode layer 114 to transmit the electromagnetic signal through the opening 116. Moreover, the direction of the electromagnetic signal may be adjusted by the arrangement direction of the liquid-crystal molecules 106. In some embodiments, the first electrode layer 102 may be electrically floating, grounded, or connected to other circuits (not illustrated). The first electrode layer 102 may be used to shield the electromagnetic signal so that the electromagnetic signal may face toward the opening 116 and enhance the signal/noise ratio of the electromagnetic signal of the liquid-crystal antenna device.

However, it should be understood that one with ordinary skill in the art can adjust the amount, the shape or the arrangement (from the top view perspective) of the first electrode layer 102, the second electrode layer 114 and the corresponding openings 116 according to practical needs, and they are not limited to the aspects shown in FIG. 4.

In addition, the first sealing member 104 is disposed between the first substrate 101' and the second substrate 108'. The first sealing member 104, the first substrate 101' and the second substrate 108' define an active area AA. In some embodiments, the first sealing member 104 connects the first substrate 101' to the second substrate 108'. More specifically, the first sealing member 104 connects the first electrode layer 102 to the second electrode layer 114. The projection of the first sealing member 104 on the first substrate 101' at least partially overlaps the first electrode layer 102 and also at least partially overlaps the second electrode layer 114.

Moreover, as described above, the liquid-crystal antenna device 200 may further include the second sealing member 112 (as shown in FIG. 2G). The first sealing member 104 may be connected with the second sealing member 112 to form an enclosed area. The liquid-crystal molecules 106 are filled into the enclosed area that is defined by the first sealing member 104, the second sealing member 112, the first substrate 101' and the second substrate 108' to form the liquid-crystal layer 106*s*. In other words, the first sealing member 104 and the second sealing member 112 are disposed surrounding the liquid-crystal layer 106*s*.

In addition, the liquid-crystal antenna device 200 may further include at least a spacer element 118 in accordance with some embodiments. The spacer element 118 is disposed between the first substrate 101' and the second substrate 108', and the spacer element 118 may be disposed in the liquid-crystal layer 106*s*. The spacer 118 may be used to reinforce the structural strength of the liquid-crystal antenna device 200. In some embodiments, the spacer elements 118 extend along a direction that is substantially perpendicular to the first substrate 101' or the second substrate 108'.

The spacer elements 118 may be a ring structure in accordance with some embodiments. In some other embodiments, the spacer element 118 may include a plurality of columnar structures and the columnar structures may be arranged in parallel. In addition, the spacer element 118 may be formed of an insulating material or a conductive material. In some embodiments, the material of the spacer element 118 may include, but is not limited to, copper, silver, gold, copper alloys, silver alloys, gold alloys, or a combination thereof. In some embodiments, the spacer element 118 may be formed of a single material or composite materials. For example, in other embodiments, the material of the spacer element 118 may include, but is not limited to, polyethylene terephthalate (PET), polyethylene (PE), polyethersulfone (PES), polycarbonate (PC), polymethylmethacrylate (PMMA), glass, any other suitable materials, or a combination thereof. In some embodiments, the spacer element 118 may be adhesive.

Figure 5B:
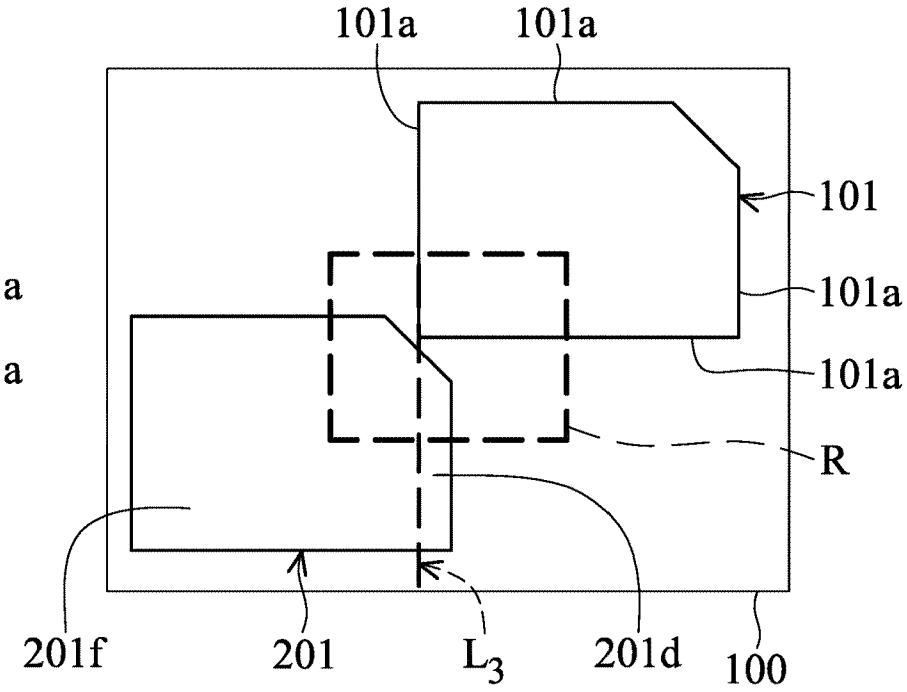
FIGS. 5A and 5B illustrate the aspects of arrangement of the liquid-crystal antenna devices on the first mother substrate during the manufacture in accordance with some embodiments of the present disclosure.
Figure 5A:
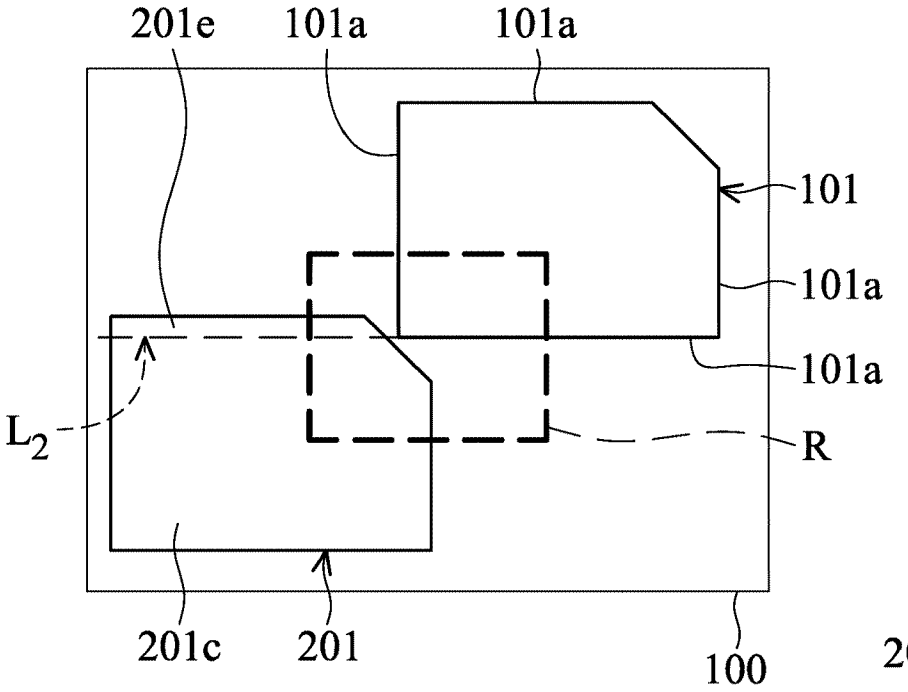

Next, referring to FIG. 5A, FIG. 5A illustrates the aspects of arrangement of the liquid-crystal antenna devices 200 on the first mother substrate 100 during the manufacture in accordance with some embodiments of the present disclosure. As described above, the first mother substrate 100 may include a plurality of regions corresponding to where the liquid-crystal antenna devices 200 that are subsequently formed. In this embodiment, the first mother substrate 100 includes the first region 101 and the second region 201. The first region 101 and the second region 201 are arranged in a staggered manner. The first region 101 has a plurality of first sides 101*a*. Therefore, an extension line of at least one of the first sides 101*a* may pass through the second region 201, that is to say, the extension line of the at least one of the first sides 101*a* may divide the second region 201 into two parts.

Specifically, as shown in FIG. 5A, the extension line $L_2$ of the first side 101*a* of the first region 101 divides the second region 201 into a first part 201*c* and a second part 201*e*. Similarly, the extension line $L_3$ of the first side 101*a* of the first region 101 divides the second region 201 into a third part 201*f* and a fourth part 201*d* (as shown in FIG. 5B). In addition, the area of the first region 101 is substantially the same as the area of the second region 201 in accordance with some embodiments. However, it should be understood that although only one first region 101 and one second region 201 are illustrated in the figure as an example, the first mother substrate 100 may actually have a plurality of first regions 101 and a plurality of second regions 201.

Figure 5C:
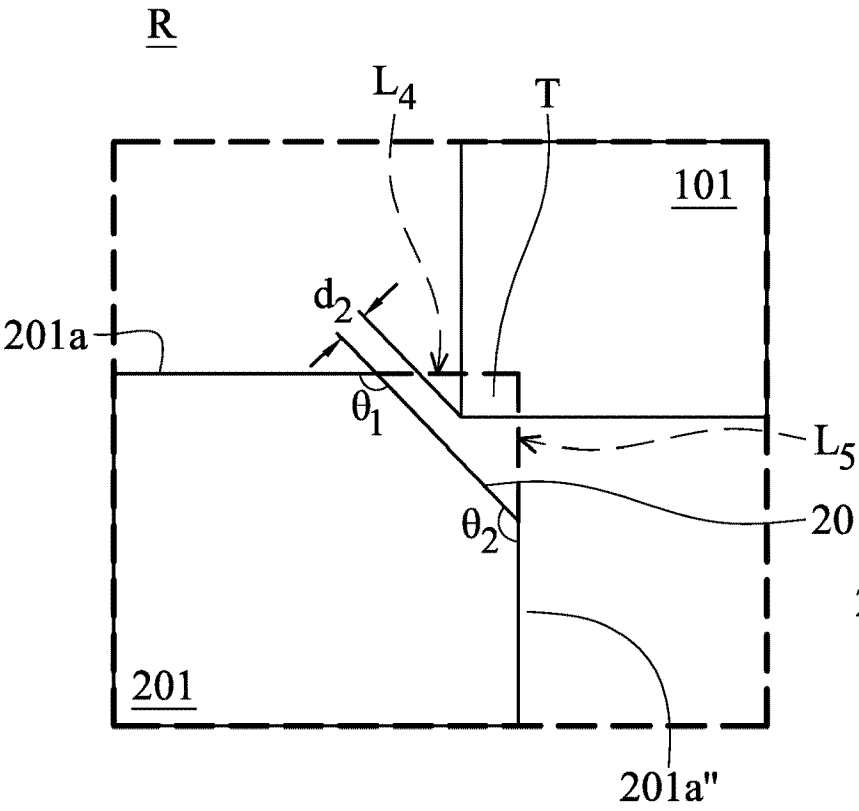
FIG. 5C illustrates a partially enlarged part of the region R as shown in FIG. 5A.

Next, referring to FIG. 5C, FIG. 5C illustrates a partially enlarged part of the region R as shown in FIG. 5A. As shown in FIG. 5C, the second region 201 may have a plurality of second sides 201*a*, 201*a*', 201*a*". The second side 201*a*' is connected to the second side 201*a* to form an obtuse angle $\theta_1$, and the second side 201*a*' is connected to the second side 201*a*" to form an obtuse angle $\theta_2$. In some embodiments, the obtuse angle $\theta_1$ is substantially equal to the obtuse angle $\theta_2$. In some other embodiments, the obtuse angle $\theta_1$ is not equal to the obtuse angle $\theta_2$. The extension line L of the second side 201*a* and the extension line $L_5$ of the second side 201*a*" form a virtual triangle T with the second side 201*a*'. The virtual triangle T partially overlaps with the first region 101. In some embodiments, the virtual triangle T may be a right triangle, an equilateral triangle, or a regular triangle, but is not limited thereto.

In some embodiments, the minimum distance $d_2$ between the second side 201*a*' of the second region 201 and the first region 101 is in a range from about 0.5 mm to about 30 mm. It should be noted that, if the minimum distance $d_2$ between the second side 201*a*' of the second region 201 and the first region 101 is too small (for example, less than 0.5 mm), the distance between the first region 101 and the second region 201 may be too close. This may make the subsequent cutting process of the substrate become more difficult, or even result in cracks of the substrate.

Figure 6:
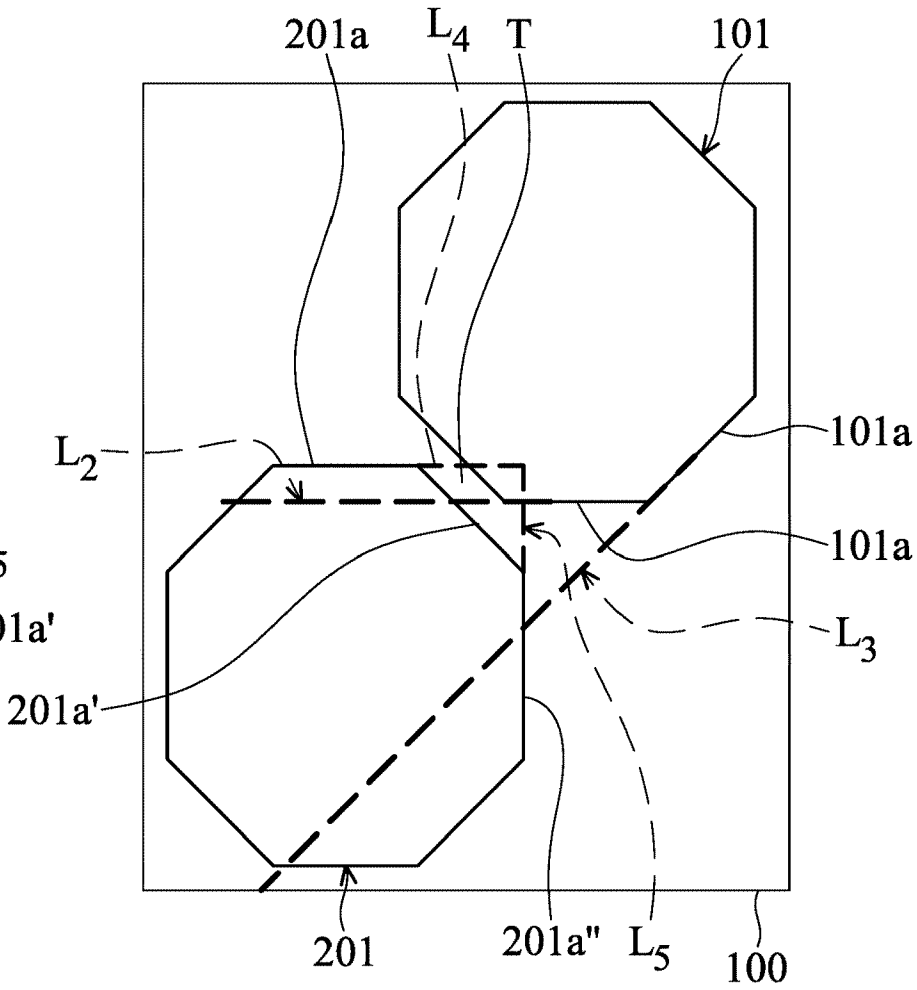
FIGS. 6-8 illustrate the aspects of arrangement of the liquid-crystal antenna devices on the first mother substrate during the manufacture in accordance with some embodiments of the present disclosure.
Figure 8:
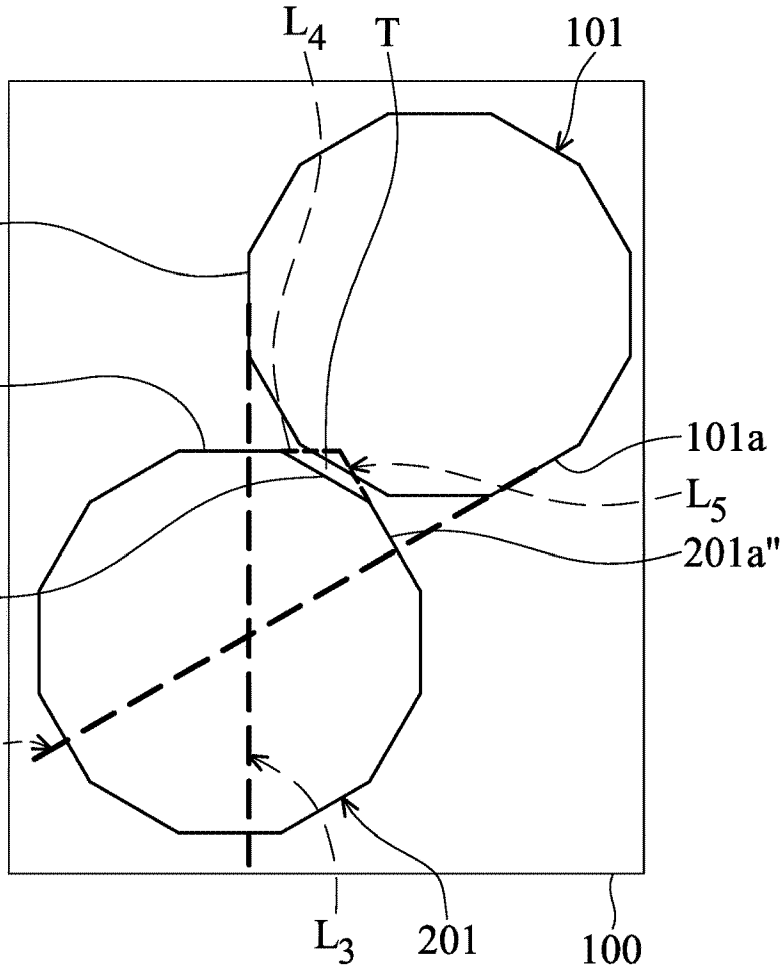
Figure 7:
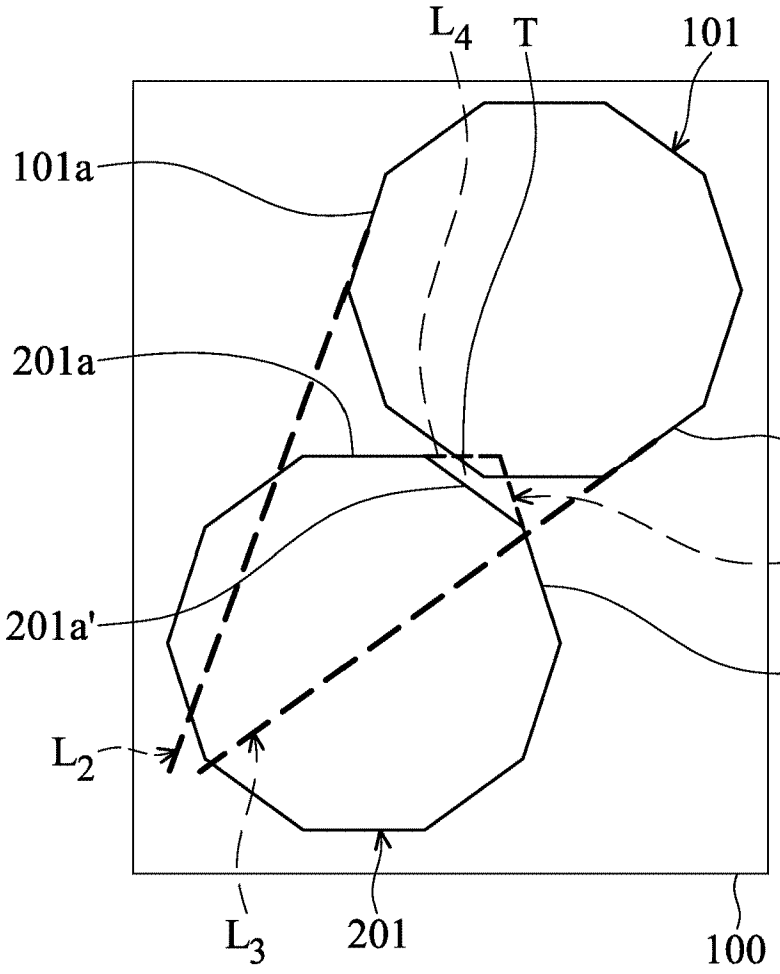

In addition, the first region 101 and the second region 201 may have any suitable shape, as long as at least one side of the shape may form an obtuse angle with the two adjacent sides. As shown in FIGS. 6-8, in some embodiments, the first region 101 and the second region 201 may be octagons in FIG. 6), decagons (as shown in FIG. 7), or dodecagons (FIG. 8), but they are not limited thereto. In these embodiments, the first region 101 and the second region 201 are arranged in a staggered manner. Therefore, the extension line $L_2$ or the extension line $L_3$ of the first side 101*a* of the first region 101 also divides the second region 201 into two parts. The extension line $L_4$ and the extension line $L_5$ of the second side 201*a* and the second side 201*a*" also form a virtual triangle T with the second side 201*a*', and the virtual triangle T partially overlaps with the first region 101.

Compared with the commonly used rectangular arrangement, the manufacturing method of the liquid-crystal antenna device as described above can effectively improve the utilization rate of the substrate by using the non-rectangular and staggered arrangement. More specifically, the utilization rate of the substrate can be increased by about 30% to about 100%.

In summary, the method for manufacturing the liquid-crystal antenna device provided in the present disclosure may have both advantages of the traditional liquid-crystal injection method and the one drop filling (ODF) method. The amount of liquid-crystal injected can be precisely controlled so as to achieve the optimum amount of liquid-crystal or reduce the generation of a liquid-crystal gap. The performance of the liquid-crystal antenna device can be enhanced accordingly. In addition, the present disclosure also provides multiple arrangements of the liquid-crystal antenna device during the process. The non-rectangular staggered arrangement can effectively improve the utilization of the substrate.

Although some embodiments of the present disclosure and their advantages have been described in detail, it should be understood that various changes, substitutions and alterations can be made herein without departing from the spirit and scope of the disclosure as defined by the appended claims. For example, it will be readily understood by one of ordinary skill in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method for manufacturing a liquid-crystal antenna device, comprising the following steps:

(a) providing a first mother substrate, wherein the first mother substrate comprises a first region and a second region, the first region has a plurality of first sides, wherein an extension line of one of the plurality of first sides divides the second region into a first part and a second part, wherein the second region has a plurality of second sides, and one of the plurality of second sides and another two of the plurality of second sides that are adjacent to the one of the plurality of second sides form a first obtuse angle and a second obtuse angle respectively;

(b) forming a first electrode layer on the first region and the second region; and (c) cutting the first mother substrate along the plurality of first sides of the first region to obtain a first substrate; and (c1) cutting the first mother substrate along the plurality of second sides of the second region to obtain a second substrate.

2. The method as claimed in claim 1, wherein an area of the first region is substantially the same as an area of the second region.

3. The method as claimed in claim 1, wherein the one of the plurality of second sides and the extension lines of the another two of the plurality of second sides that are adjacent to the one of the plurality of second sides form a virtual triangle, wherein the virtual triangle partially overlaps the first region.

4. The method as claimed in claim 1, further comprising the following step before step (c):

(d) disposing a first sealing member on the first region of the first mother substrate to define an active area.

5. The method as claimed in claim 4, further comprising the following steps before step (c):

(e) dripping a liquid-crystal molecule in the active area; and (f) providing a second mother substrate, wherein the first sealing member is disposed between the second mother substrate and the first region of the first mother substrate.

6. The method as claimed in claim 5, wherein the first sealing member further comprises a protruding part, and a projection of the protruding part is located within the first region.

7. The method as claimed in claim 6, further comprising the following steps after step (c):

(g) cutting the first mother substrate and the second mother substrate along a first line segment that penetrates the protruding part to form an opening; and (h) sealing the opening with a second sealing member.

8. The method as claimed in claim 5, wherein the first sealing member further comprises a protruding part, and at least a part of a projection of the protruding part is located outside the first region.

9. The method as claimed in claim 5, wherein the first sealing member is disposed between the first electrode layer and a second electrode layer disposed on the second mother substrate.

10. The method as claimed in claim 1, wherein the material of the first mother substrate comprises glass, polyimide (PI), liquid-crystal polymers (LCP), or a combination thereof.

11. A method for manufacturing a liquid-crystal antenna device, comprising the following steps:

(a) providing a first mother substrate, wherein the first mother substrate comprises a first region, and the first region has a plurality of first sides;

(b) forming a first electrode layer on the first region;

(c) disposing a first sealing member on the first region of the first mother substrate to define an active area;

(d) dripping a liquid-crystal molecule in the active area;

(e) providing a second mother substrate, wherein the first sealing member is disposed between the first mother substrate and the second mother substrate;

(f) cutting the first region and the second mother substrate along the plurality of first sides of the first region, wherein the first sealing member comprises a protruding part, and the first sealing member and the protruding part are located within the first region;

(g) cutting the first region and the second mother substrate along a first line segment that penetrates the protruding part to form an opening; and (h) sealing the opening with a second sealing member.

12. The method as claimed in claim 11, wherein the second sealing member protrudes from the first line segment by a distance, wherein the distance is in a range from 0 mm to 1 mm.

13. The method as claimed in claim 11, wherein the first sealing member connects the first electrode layer to a second electrode layer disposed on the second mother substrate.

* * * * *